US009222287B2

(12) United States Patent
Huang et al.

(10) Patent No.: US 9,222,287 B2
(45) Date of Patent: Dec. 29, 2015

(54) OBJECT GRIPPING DEVICE USING ELECTROMAGNETIC ASSEMBLY

(71) Applicant: Quanta Computer Inc., Taoyuan Shien (TW)

(72) Inventors: Lin-Wei Huang, Taoyuan Shien (TW); Sheng-Feng Chen, New Taipei (TW); Jung-Wen Chang, Taoyuan County (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 366 days.

(21) Appl. No.: 13/872,788

(22) Filed: Apr. 29, 2013

(65) Prior Publication Data

US 2014/0053617 A1 Feb. 27, 2014

(30) Foreign Application Priority Data

Aug. 21, 2012 (TW) ..... 101130288 A

(51) Int. Cl.

| | |
|---|---|
| ***E05C 17/56*** | (2006.01) |
| ***E05B 73/00*** | (2006.01) |
| ***E05B 47/06*** | (2006.01) |
| ***E05B 47/00*** | (2006.01) |
| *E05C 3/06* | (2006.01) |

(52) U.S. Cl.

CPC ..... *E05B 73/0082* (2013.01); *E05B 47/0004* (2013.01); *E05B 47/0603* (2013.01); *Y10T 70/5009* (2015.04)

(58) Field of Classification Search

CPC ..... E05B 73/0082

USPC ..... 292/251.5, 201, 195, 198, 256, 257, 292/216, 194, 215, 224, 197, 292/341.15–341.17; 70/275–277, 281; 248/127, 130, 146, 149, 150, 154

See application file for complete search history.

(56) References Cited

U.S. PATENT DOCUMENTS

| | | | | |
|---|---|---|---|---|
| 2,325,225 | A * | 7/1943 | Burke | 292/123 |
| 2,849,250 | A * | 8/1958 | Williamson | 292/92 |
| 2,867,465 | A * | 1/1959 | Van Noord | 292/216 |
| 3,201,960 | A * | 8/1965 | Berkowitz | 70/150 |
| 4,545,606 | A * | 10/1985 | Vodra | 292/92 |
| 2008/0231060 | A1 * | 9/2008 | Carabalona et al. | 292/251.5 |

OTHER PUBLICATIONS

"What is a Solenoid Valve," www.solenoid-valve-info.com/solenoid-valve-definition.html, Jun. 24, 2015.*

* cited by examiner

*Primary Examiner* — Alyson M Merlino
(74) *Attorney, Agent, or Firm* — Rabin & Berdo, P.C.

(57) ABSTRACT

An object gripping device using a electromagnetic assembly includes a base having two opposite ends thereof, a fastening portion pivoted at one end of the base and having an object-gripping trench and a through opening having a stopping surface therein at two opposite ends of the fastening portion, a transmission portion pivoted at the other end of the base, a stopping shaft extending through both the transmission portion and the through opening, a first spring connected both the base and the fastening portion, a second spring connected both the base and the transmission portion, and a electromagnetic assembly connected the base and the transmission portion.

10 Claims, 13 Drawing Sheets

OBJECT GRIPPING DEVICE USING ELECTROMAGNETIC ASSEMBLY

RELATED APPLICATIONS

This application claims priority to Taiwan Application Serial Number 101130288, filed Aug. 21, 2012, which is herein incorporated by reference.

BACKGROUND

1. Technical Field

The present disclosure relates to an object gripping device, and more particularly to an object gripping device using a electromagnetic assembly.

2. Description of Related Art

In general physical stores or exhibition venues, actual portable electronic products of many brands, (such as mobile phones, tablet computers, cameras, game consoles or alike) are usually placed on showcases for customers to have free trial and conduct comparison. However, if field personnel are inattentive, the portable electronic products are likely to be stolen, thus causing losses.

To prevent the portable electronic products in exhibition from being stolen, most of the physical stores use exposed security locking means, such as steel cables or locks, to lock the portable electronic products to the showcase.

However, the aforementioned method of locking the portable electronic products to the showcase may let customers feel like potential thieves, and is disadvantageous to store atmosphere and promoting purchasing intentions of customers or users.

SUMMARY

One aspect of the present disclosure is to provide an object gripping device using a electromagnetic assembly for temporarily gripping an object firmly so as to prevent the object from being be taken away unexpectedly.

Another aspect of the present disclosure is to provide an object gripping device using electromagnetic assembly for placing an exhibited object in an exhibition site with concealing a security locking means for the exhibited object, so as to simplify the appearance of the exhibition site.

An embodiment of the present disclosure is to disclose an object gripping device using a electromagnetic assembly. The object gripping device comprises a base, a fastening portion, a first spring, a transmission portion, a stopping shaft, a second spring and a electromagnetic assembly. The fastening portion is pivoted at one end of the base. An object-gripping trench is provided at one end of the fastening portion, and a through opening having a stopping surface therein is provided at the other end of the fastening portion. The first spring is connected to the base and the fastening portion, and drives the fastening portion to rotate in a first rotation direction (such as a clockwise direction). The transmission portion is pivoted at the other end of the base. The stopping shaft passes through the transmission portion and the through opening. The second spring is connected to the base and the transmission portion, and drives the transmission portion to rotate in a second rotation direction (such as a counter-clockwise direction) opposite to the first rotation direction. The electromagnetic assembly comprises an outer case, a displacement piece and a electromagnet. The outer case is fixed on the other end of the base. The displacement piece is linearly and movably disposed on the outer case, and is connected to the transmission portion. The electromagnet is disposed in the outer case.

When the displacement piece is magnetically attracted to the electromagnet by a magnetic force thereof to stop the transmission portion from rotating in the second rotation direction, the stopping shaft contacts the stopping surface for stopping the fastening portion from rotating in the first rotation direction so as to allow an object to be fixedly gripped in the object-gripping trench. When the electromagnetic assembly reduces the magnetic force according to a trigger signal, the transmission portion is allowed to rotate in the second rotation direction, the stopping shaft is detached from the stopping surface to allow the fastening portion to rotate, thereby releasing the object from the object-gripping trench.

To sum up, since the object gripping device using a electromagnetic assembly not only provides an exhibiting placement, but also provides a concealed security locking means for the exhibited object, the appearance of the exhibition site is simplified, the atmosphere in the exhibition site is better, and purchasing intentions of customers are promoted.

BRIEF DESCRIPTION OF THE DRAWINGS

The present disclosure will be apparent to those skilled in the art by reading the following detailed description of a preferred embodiment thereof, with reference to the attached drawings, in which.

DESCRIPTION OF THE EMBODIMENTS

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
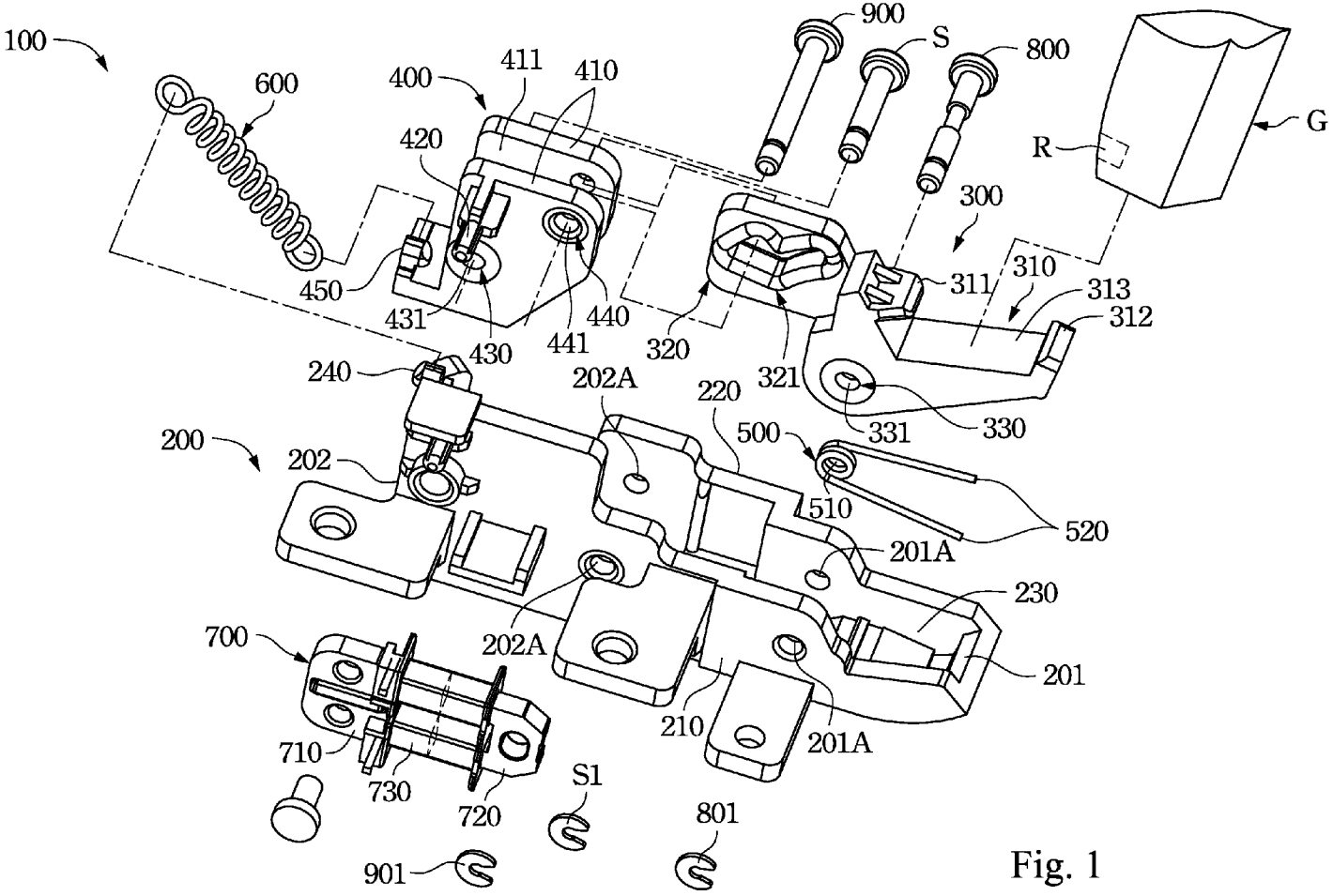
FIG. 1 is an exploded view of an object gripping device using a electromagnetic assembly according to an embodiment of the present disclosure.

Reference is now made to FIG. 1. FIG. 1 is an exploded view of an object gripping device 100 using a electromagnetic assembly according to an embodiment of the present disclosure. The object gripping device 100 can be installed on a fixed stand, e.g., a display table, for exhibiting or placing an object such as mobile phones, cameras, game consoles or alike.

The object gripping device 100 comprises a base 200, a fastening portion 300, a transmission portion 400, a first spring 500, a second spring 600, a electromagnetic assembly 700, a first pivot rod 800, a second pivot rod 900 and a stopping shaft S.

The base 200 is shaped in a longitudinal shape, and provided with a first long side face 210, a second long side face 220 and a longitudinal groove 230. The first long side face 210 and the second long side face 220 are opposite with each other. The longitudinal groove 230 is disposed on one surface, defined between the first long side face 210 and the second long side face 220, of the base 200. The longitudinal groove 230 includes a first end 201 and a second end 202 which are opposite with each other.

Figure 2A:
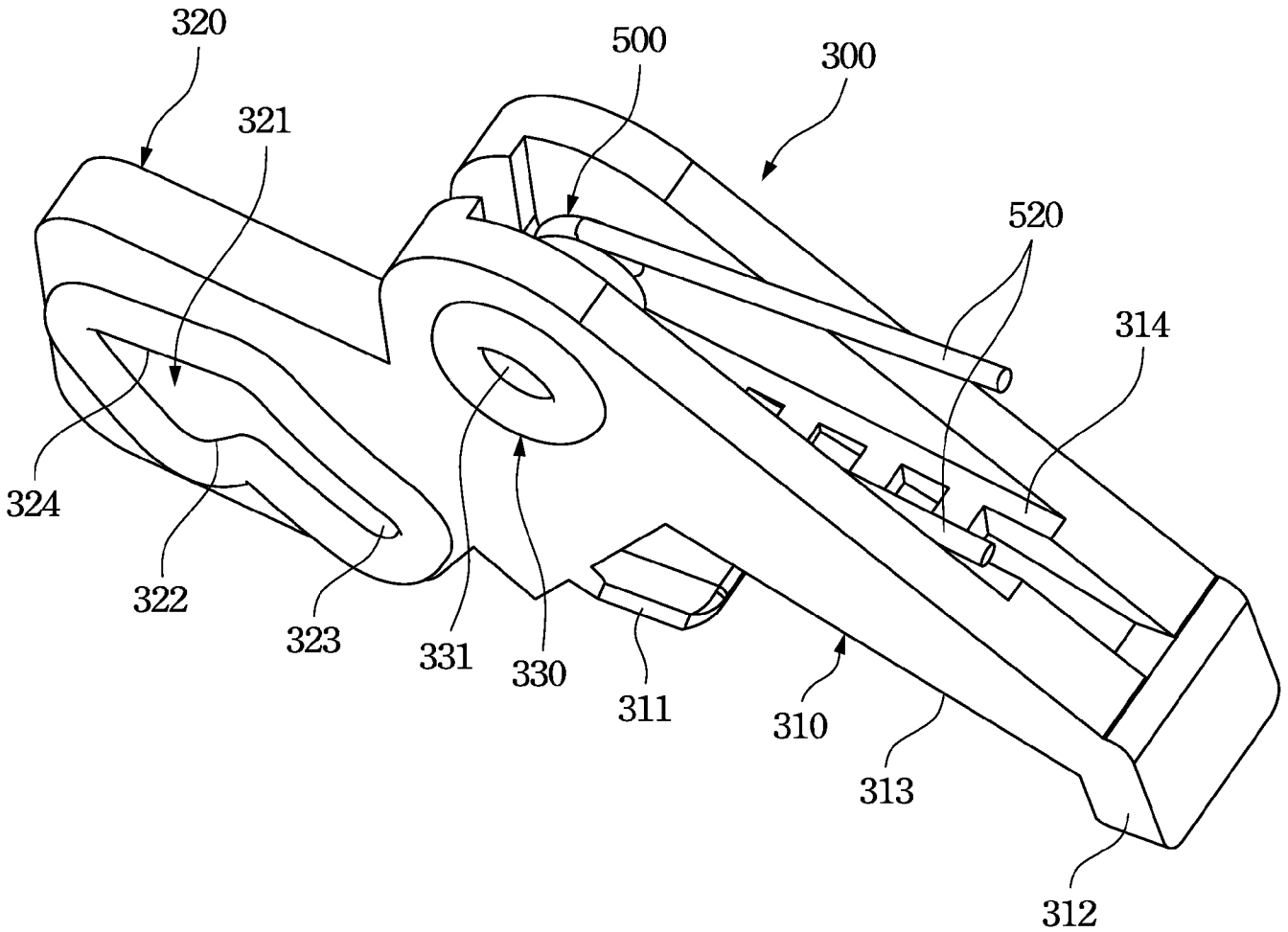
FIG. 2A is an assembly view of a fastening portion and a first spring shown in FIG. 1.

Reference is now made to FIG. 1 and FIG. 2A. FIG. 2A is an assembly view of the fastening portion 300 and the first spring 500 of FIG. 1.

The fastening portion 300 is pivoted at the first end 201 of the longitudinal groove 230, and thus, the fastening portion 300 can be rotated in the longitudinal groove 230.

Substantially, the fastening portion 300 includes a hook 310 and a connection plate 320 which are opposite with each other. The hook 310 includes a protruding portion 311, a stopping rib 312, an object-gripping trench 313, a spring installation recess 314 and a first pivot portion 330. The object-gripping trench 313 is disposed on one surface of the hook 310, and thus, an object G can be inserted into the object-gripping trench 313 for installation or exhibition. A width of the object-gripping trench 313 is almost equal to a thickness of the object G.

The stopping rib 312 is disposed on an upper edge of the object-gripping trench 313 for abutting against the object G and restricting the object G from moving horizontally. The protruding portion 311 is disposed on the other upper edge of the object-gripping trench 313 opposite to the stopping rib 312 for inserting into a recess R of the object G to restrict the object G from moving vertically. Thus, with the stopping rib 312 and the protruding portion 311, the object G can be fixedly gripped inside the object-gripping trench 313. The spring installation recess 314 is disposed on the other surface of the hook 310 opposite to the object-gripping trench 313. The first pivot portion 330 is arranged between the object-gripping trench 313 and the connection plate 320. The first pivot portion 330, for example, includes two first through holes 331. The first through holes 331 are configured on two sidewalls of the hook 310. The first through holes 331 are aligned with each other, and are in communication with the spring installation recess 314. The first spring 500 is disposed in the spring installation recess 314, and is located between the hook 310 and the base 200. The first spring 500, for example, can be a torsion spring or an extension spring. In this embodiment, the first spring 500 is the torsion spring in which the torsion spring includes a torsion hole 510 and two elastic rods 520. The torsion hole 510 is disposed in the spring installation recess 314, and is aligned with both of the first through holes 331. One of the two elastic rods 520 abuts against the inner surface of the longitudinal groove 230, and the other of the two elastic rods 520 abuts against the inner surface of the spring installation recess 314.

Figure 2B:
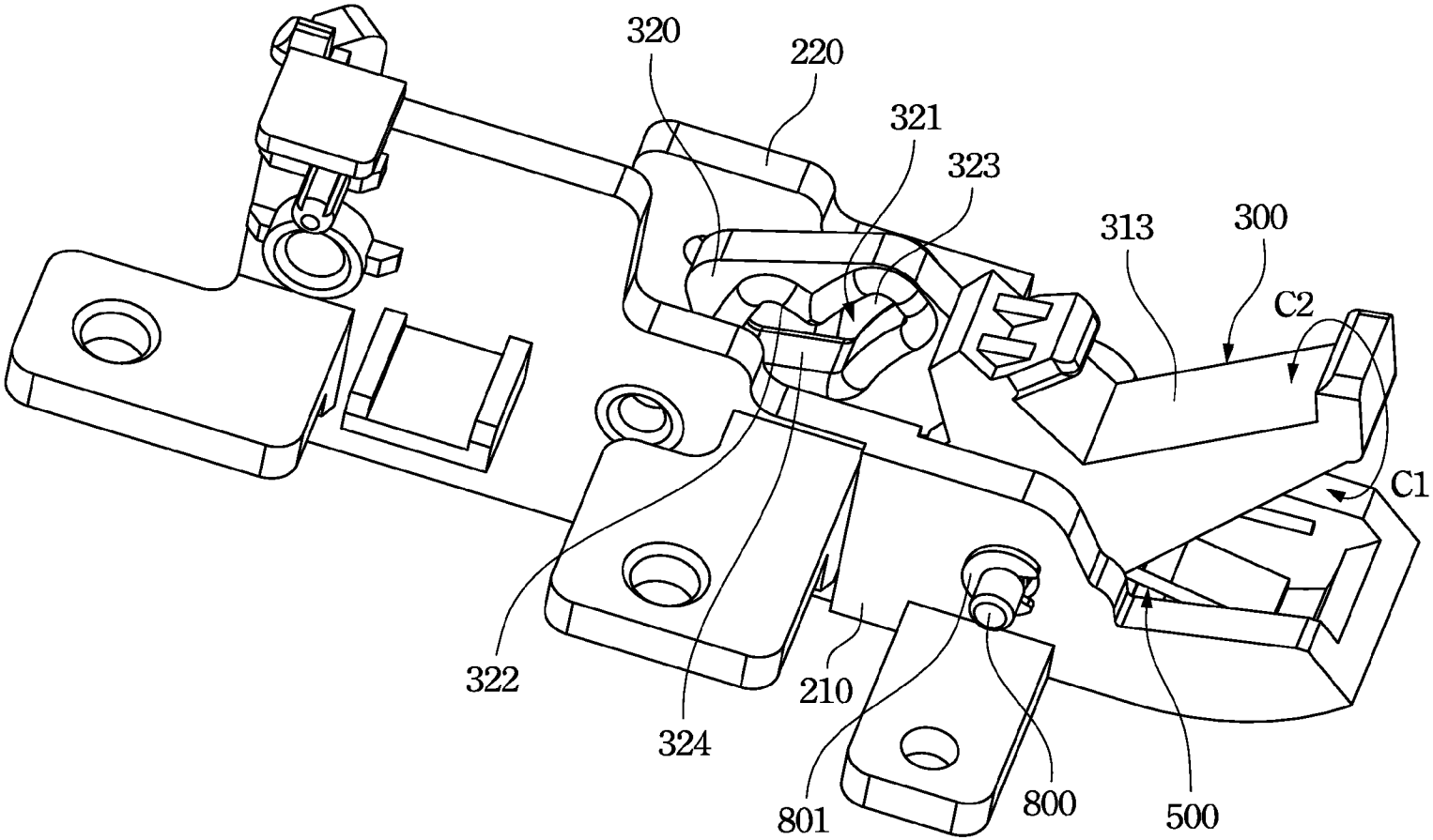
FIG. 2B is a partial assembly view of a base, the fastening portion and the first spring shown in FIG. 1.

Reference is now made to FIG. 1, FIG. 2A and FIG. 2B. FIG. 2B is a partial assembly view of the base 200, the fastening portion 300 and the first spring 500 of FIG. 1. When the fastening portion 300 rotates in a first rotation direction C1 to deform the first spring 500, the first spring 500 generates a first restoring elastic force for driving the fastening portion 300 to rotate in a second rotation direction C2 opposite to the first rotation direction C1.

After the first pivot rod 800 sequentially passes through a through hole 201A of the second long side face 220 of the base 200, one of the first through holes 331 of the first pivot portion 330, the torsion hole 510, the other one of the first through holes 331 of the first pivot portion 330, and another through hole 201A of the first long side face 210 of the base 200, the first pivot rod 800 is fixed on the base 200 by a C-ring portion 801. Thus, the first spring 500 is limited in the spring installation recess 314, and the fastening portion 300 is pivoted in the first end 201 of the longitudinal groove 230.

Refer to FIG. 1 and FIG. 2A again. A through opening 321 is formed on the connection plate 320, and the through opening 321 penetrates through two opposite main surfaces of the connection plate 320. Specifically, the through opening 321 has an unbroken contour, and comprises a stopping surface 322, a receiving area 323 and an inclined surface 324. The stopping surface 322 is on one of inner surfaces of the through opening 321. The receiving area 323 is defined in the through opening 321, and is closer to the object-gripping trench 313 than the stopping surface 322. The inclined surface 324 is on another inner surface of the through opening 321 opposite to the stopping surface 322 and is farther from the object-gripping trench 313 than the receiving area 323.

Figure 3A:
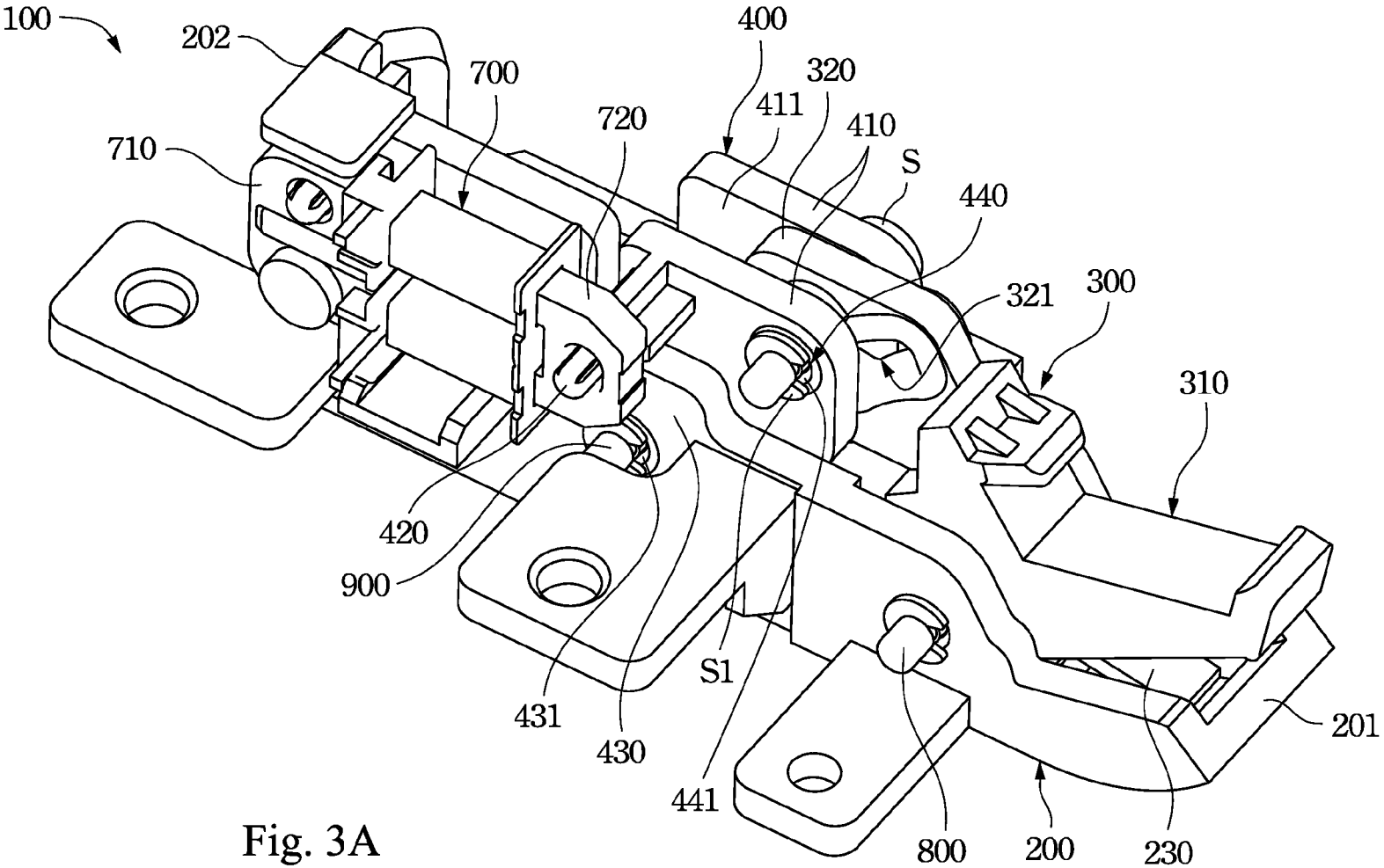
FIG. 3A is an assembly view showing the object gripping device using the electromagnetic assembly f the present disclosure from a direction.
Figure 3B:
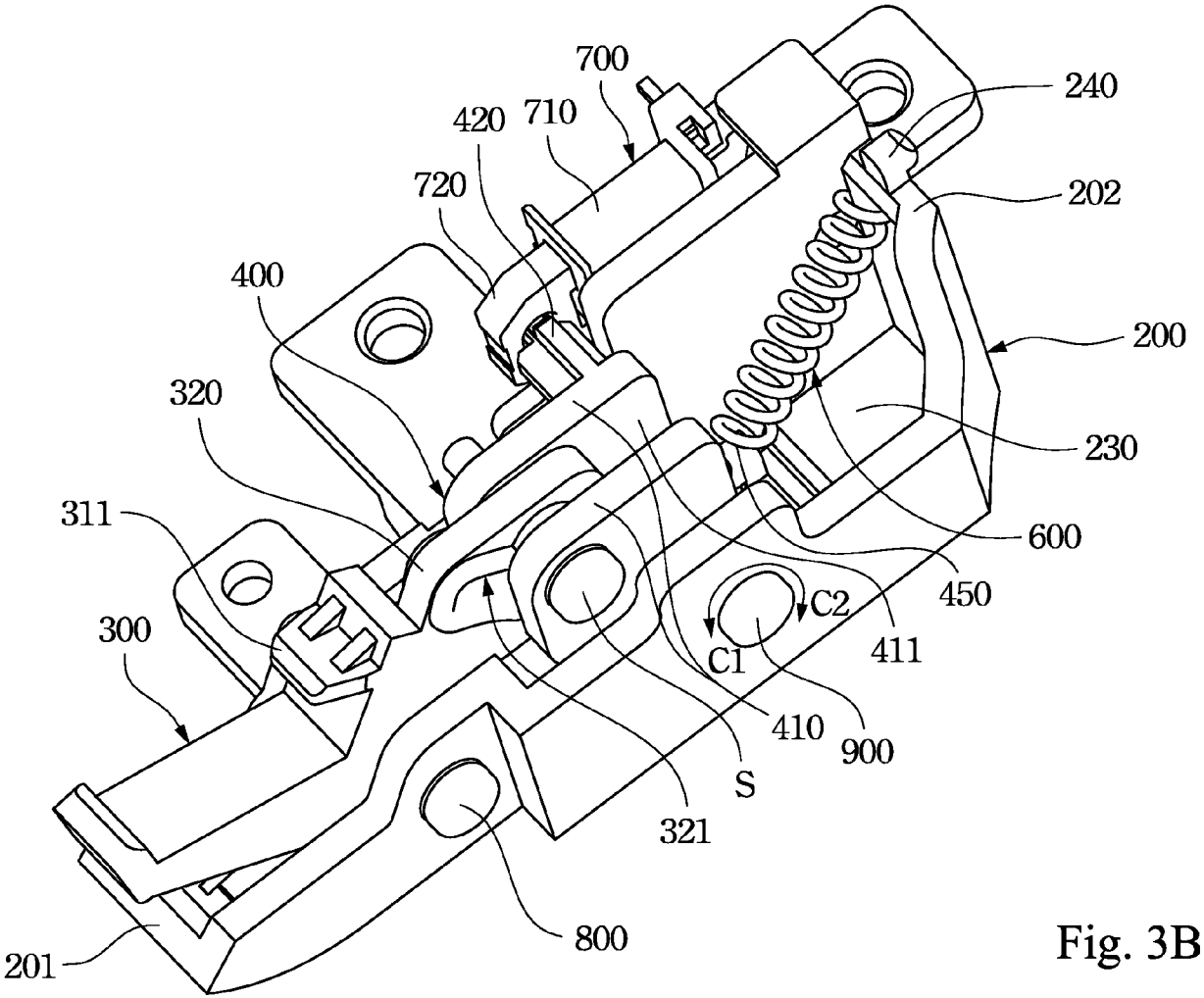
FIG. 3B is an assembly view showing the object gripping device using the electromagnetic assembly of the present disclosure from another direction.

Reference is now made to FIG. 1, FIG. 3A and FIG. 3B. FIG. 3A is an assembly view showing the object gripping device 100 using the electromagnetic assembly of the present disclosure from a direction. FIG. 3B is an assembly view showing the object gripping device 100 using the electromagnetic assembly of the present disclosure from another direction.

The transmission portion 400 is pivoted in the second end 202 of the longitudinal groove 230, and thus, the transmission portion 400 can be rotated in the longitudinal groove 230. Specifically, the transmission portion 400 includes two lugs 410, a fixing shaft 420, a second pivot portion 430 and a third pivot portion 440 at one end thereof, and a connection portion 450 at the other end thereof. A gap 411 is defined between the two lugs 410. The fixing shaft 420 is disposed on an outer surface of one of the lugs 410. The third pivot portion 440, for example, includes two third through holes 441 respectively disposed on the lugs 410 proximal to an end thereof closest to the object-gripping trench 313. The third through holes 441 are aligned with each other, and the third through holes 441 are in communication with the gap 411. The second pivot portion 430, for example, includes two second through holes 431 respectively disposed on the lugs 410 distal to the end thereof closest to the object-gripping trench 313, and is disposed between the connection portion 450 and one of the third through holes 441, and the second through holes 431 are in communication with the gap 411.

After the second pivot rod 900 sequentially passes through a through hole 202A of the other end of the second long side face 220 of the base 200, one of the second through holes 431 of the second pivot portion 430, the other one of the second through holes 431 of the second pivot portion 430, and another through hole 202A of the other end of the second long side face 220 of the base 200, the second pivot rod 900 is fixed on the base 200 by a C-ring portion 901. Thus, the transmission portion 400 is pivoted in the second end 202 of the longitudinal groove 230.

Furthermore, the second spring 600, for example, can be a torsion spring or an extension spring. In this embodiment, the second spring 600 is the extension spring in which one end of the extension spring is hooked on the connection portion 450, and the other end of the extension spring is hooked on a hook 240 on the other end of the base 200.

Thus, when the transmission portion 400 rotates in the second rotation direction C2 to deform the second spring 600, the second spring 600 generates a second restoring elastic force for driving the transmission portion 400 to rotate in the first rotation direction C1.

Further, refer to FIG. 1, FIG. 3A and FIG. 3B again. The connection plate 320 of the fastening portion 300 extends into the gap 411 defined between the two lugs 410, such that the through opening 321 of the connection plate 320 is disposed between the two lugs 410.

After the stopping shaft S sequentially passes through one of the third through holes 441, the through opening 321 and the other one of the third through holes 441, the stopping shaft S is fixed on the transmission portion 400 by a C-ring portion 51. Thus, since the stopping shaft S stays in the through opening 321, and the area of the through opening 321 is greater than that of each third through hole 441, the stopping shaft S can be moved to contact one of the inner surfaces of the through opening 321 with respect to the rotation of the fastening portion 300.

Figure 4:
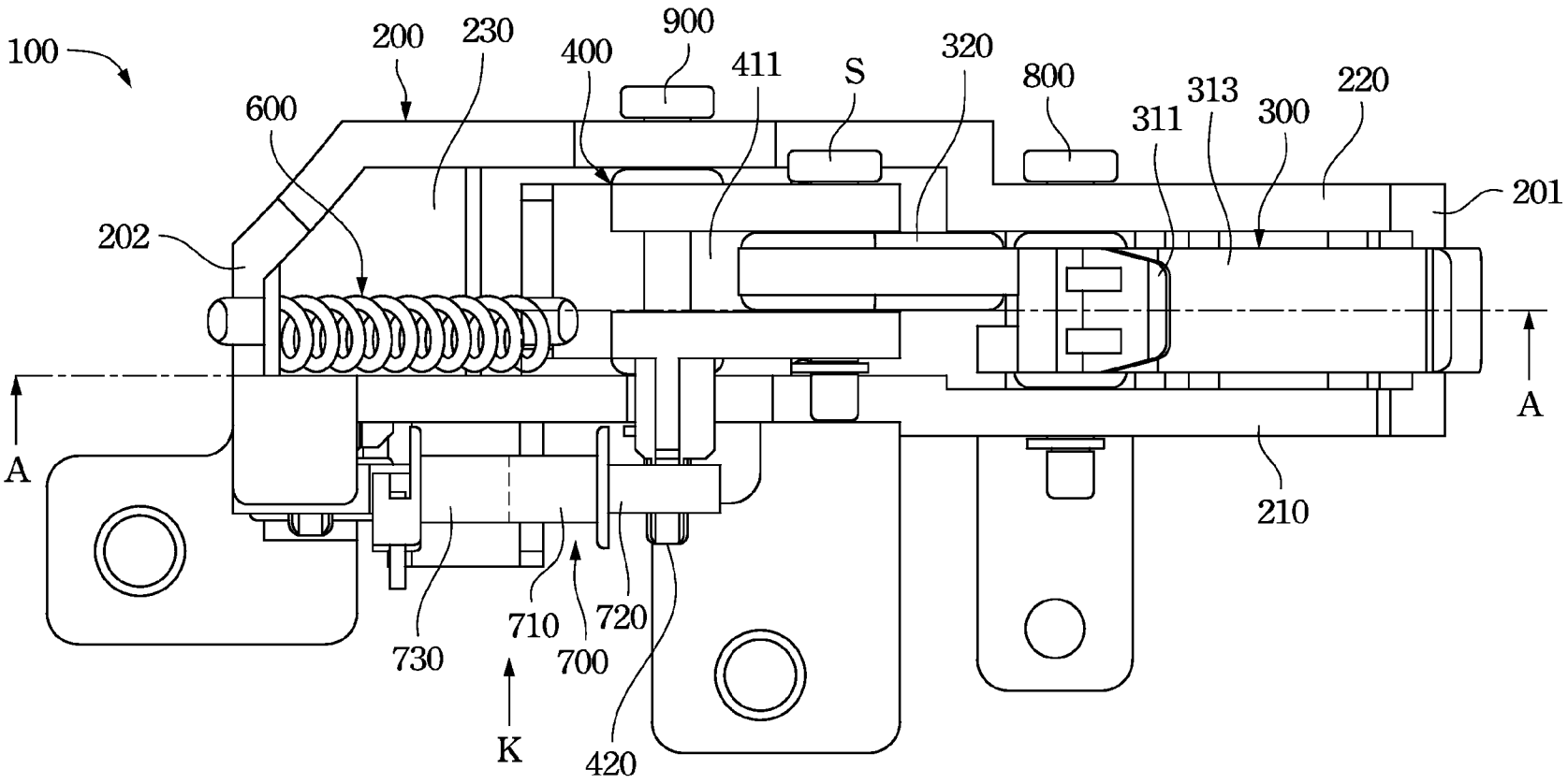
FIG. 4 is a top view of the object gripping device using the electromagnetic assembly of the present disclosure.

Reference is now made to FIG. 1, FIG. 3A and FIG. 4. FIG. 4 is a top view of the object gripping device 100 using the electromagnetic assembly 700 of the present disclosure.

The electromagnetic assembly 700 comprises an outer case 710, a displacement piece 720 and a electromagnet 730. The outer case 710 is fixed on outer surface of the other end of the first long side face 210 of the base 200. The electromagnet 730 is disposed in the outer case 710 for magnetically attracting the displacement piece 720 to repeatedly reciprocate by a magnetic force thereof. The displacement piece 720 is linearly and movably disposed on the outer case 710 in which one end of the displacement piece 720 is linearly and movably disposed in the outer case 710, and the other end of the displacement piece 720 is connected to the transmission portion 400 by the fixing shaft 420.

Figure 5A:
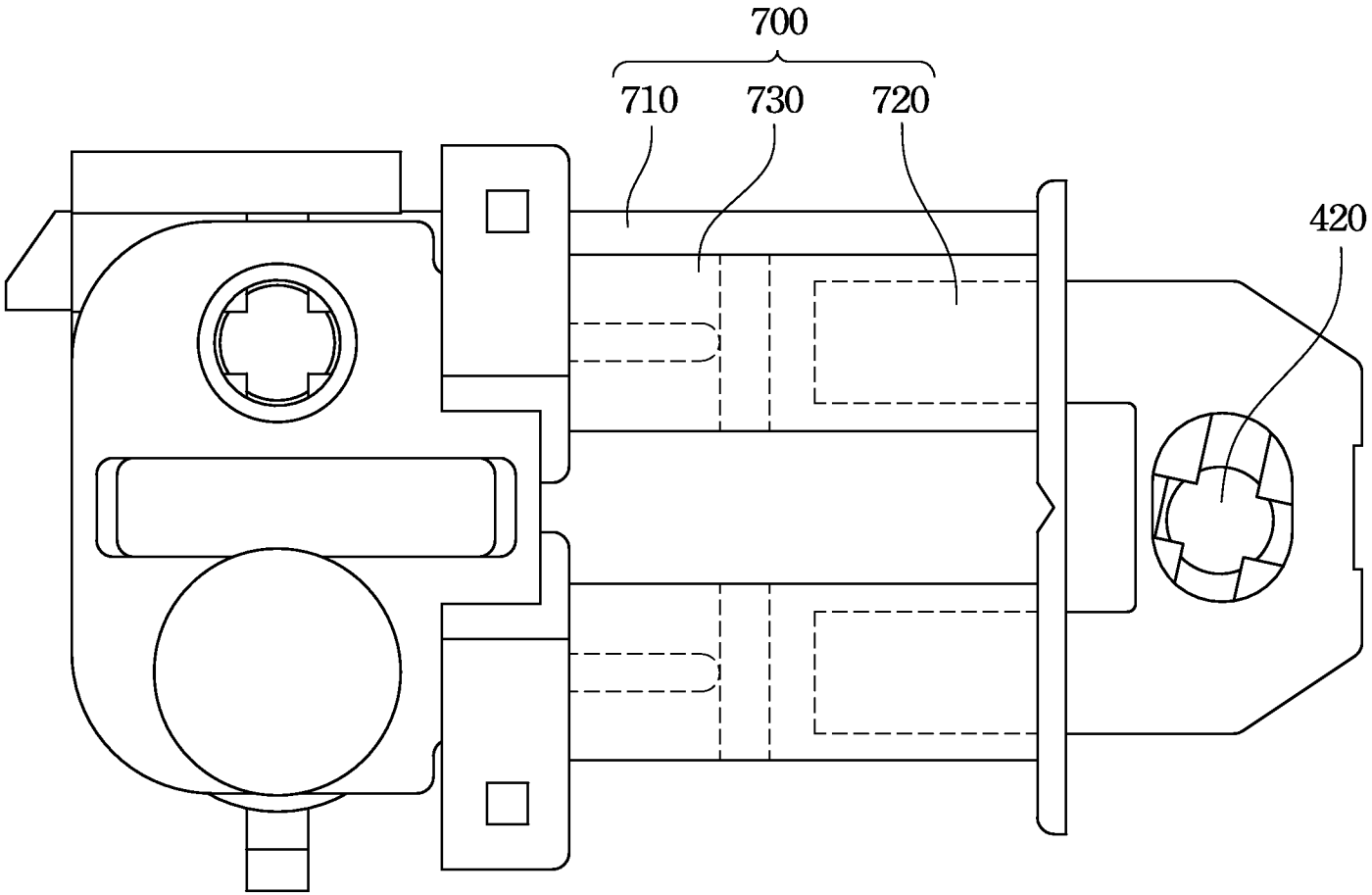
FIG. 5A is a schematic view of the electromagnetic assembly of FIG. 4 viewed from a direction K, when the electromagnetic assembly is in an open state.
Figure 5B:
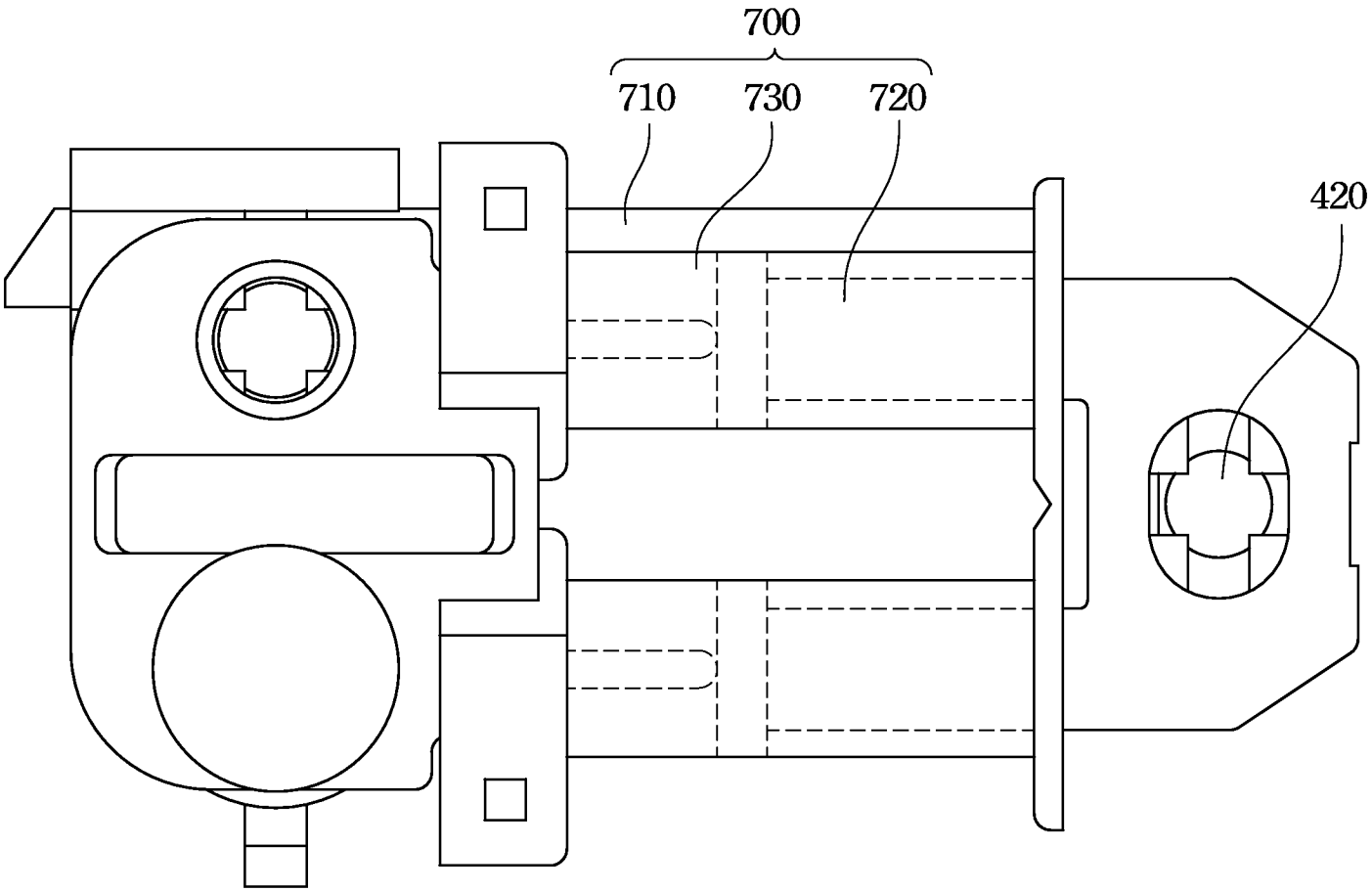
FIG. 5B is a schematic view of the electromagnetic assembly of FIG. 4 viewed from the direction K, when the electromagnetic assembly is in a close state.

Thus, when the displacement piece 720 is magnetically attracted to contact the electromagnet 730 by the magnetic force thereof, the electromagnetic assembly 700 is in a close state (FIG. 5B). On the other hand, when the magnetic force is reduced suddenly, the electromagnet 730 is unable to magnetically attach the displacement piece 720 by the magnetic force. The displacement piece 720 is moved with the rotation of the transmission portion 400 so as to retain a distance from the electromagnet 730. Thus, the electromagnetic assembly 700 is in an open state (FIG. 5A). In the other words, when the electromagnetic assembly 700 is in a close state, a section of the displacement piece 720 in the outer case 710 is larger or longer than that when the electromagnetic assembly 700 is in an open state.

FIG. 5A is a schematic view of a electromagnetic assembly 700 of FIG. 4 viewed from a direction K, when the electromagnetic assembly 700 is in an open state. FIG. 6A to FIG. 6D are cross-sectional views of FIG. 4 viewed along A-A, and are continuous processing schematic views showing that the object-gripping device 100 using the electromagnetic assembly 700 is operated from gripping the object to releasing the object.

Figure 6A:
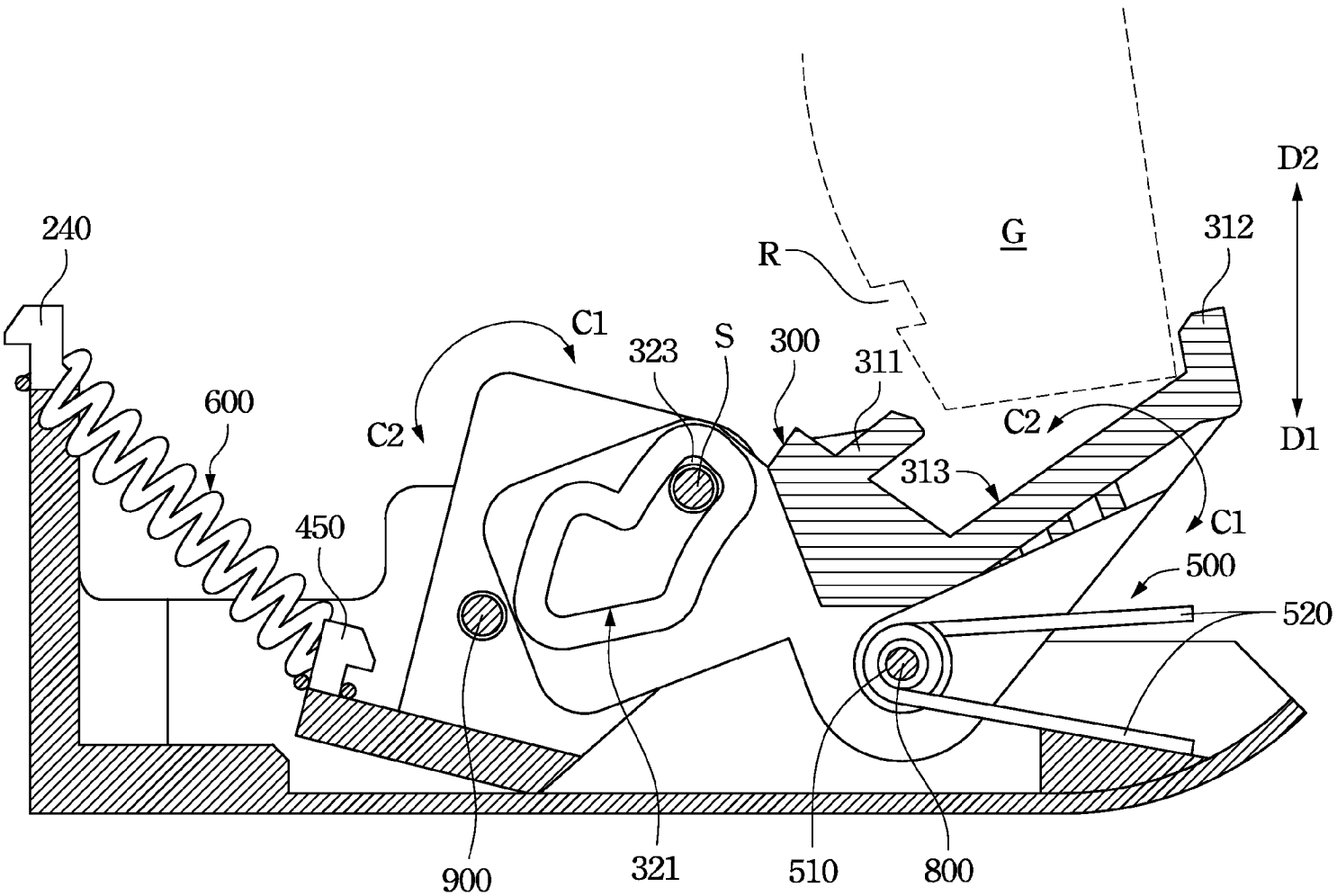
FIG. 6A to FIG. 6D are cross-sectional views of FIG. 4 viewed along A-A, and are continuous processing schematic views showing that the object gripping device using the electromagnetic assembly is operated from gripping the object to releasing the object.

Refer to FIG. 5A and FIG. 6A, after the second spring 600 pulls the transmission portion 400 and rotates the transmission portion 400 in the first rotation direction C1, the second spring 600 returns into a stationary state. At this moment, the stopping shaft S stays in the receiving area 323 of the through opening 321 and fails to restrict the fastening portion 300 from rotating, such that the first spring 500 drives the fastening portion 300 to rotate in the second rotation direction C2. Therefore, the object G can be released from the object-gripping trench 313 until the first spring 500 returns into a stationary state.

Figure 6B:
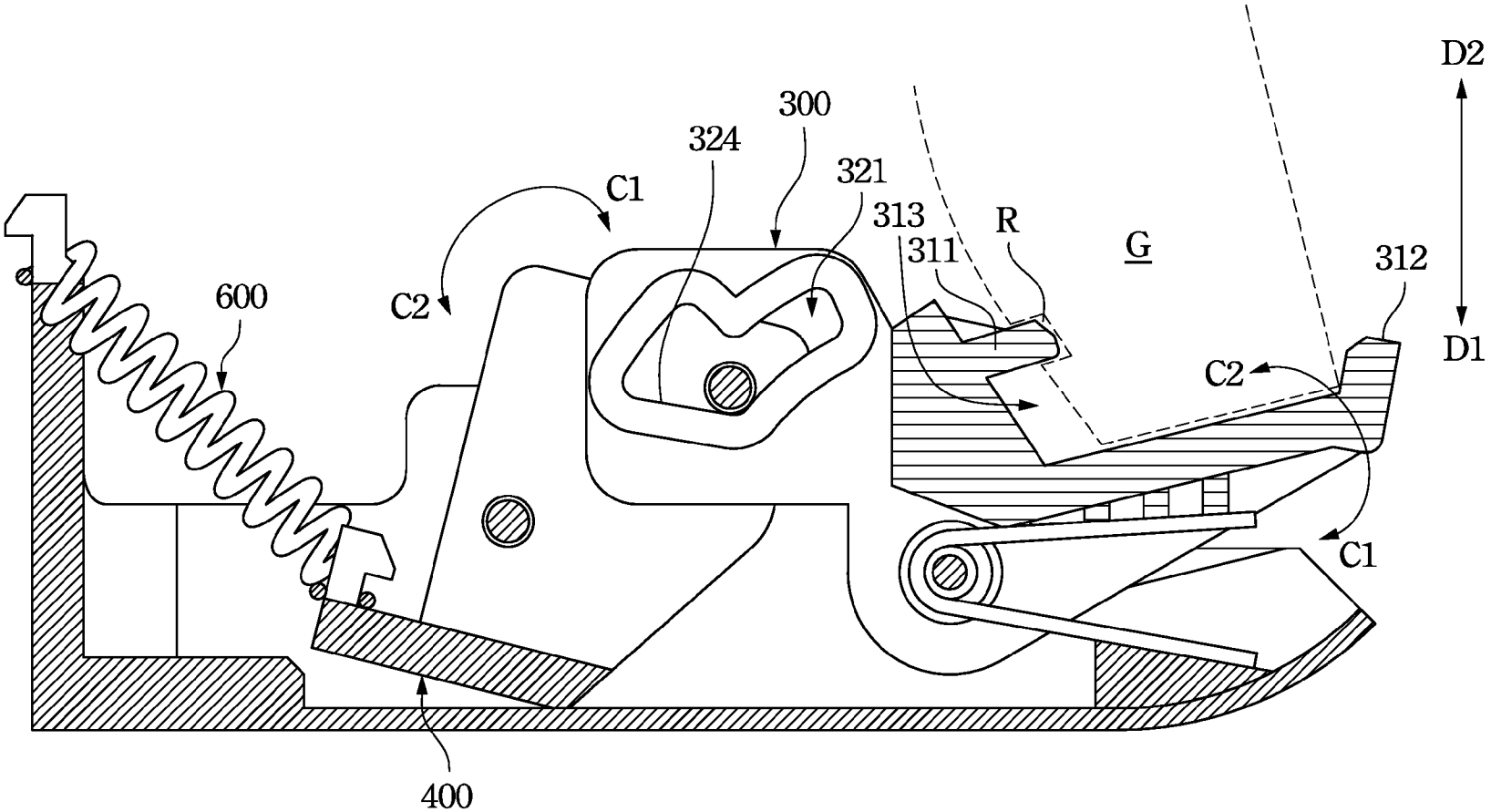

Refer to FIG. 6A to FIG. 6B, when a user inserts an object G into the object-gripping trench 313 in the first linear direction D1, the fastening portion 300 is rotated in the first rotation direction C1. At the moment, since the stopping rib 312 abuts against the object G, and the protruding portion 311 inserts into the recess R of the object G, the object G is fixedly gripped in the object-gripping trench 313. At the same time, the stopping shaft S is relatively moved to a proximal end of the inclined surface 324 (FIG. 6B) from the receiving area 323 of the through opening 321 (FIG. 6A). Because the fastening portion 300 rotates in the first rotation direction C1, the first spring 500 is deformed to generate the first restoring elastic force for driving the fastening portion 300 to rotate in the second rotation direction C2.

Figure 6C:
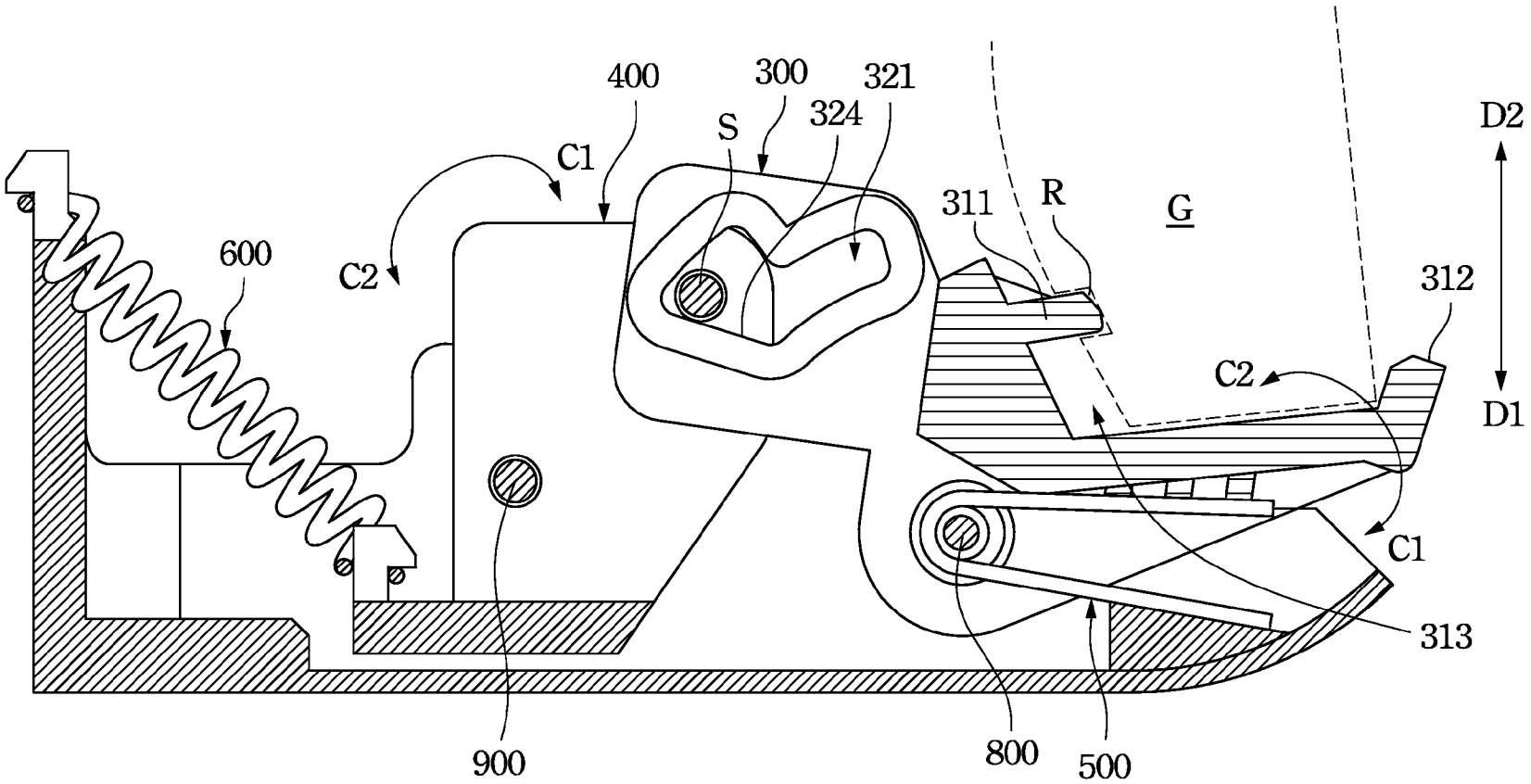

Referring to FIG. 6B to FIG. 6C, then, after the object G is fixedly gripped in the object-gripping trench 313, the user continues to press the fastening portion 300 down in the first linear direction D1 by the object G. The fastening portion 300 still rotates in the first rotation direction C1, such that the inclined surface 324 lifts the stopping shaft S and the transmission portion 400, and the transmission portion 400 is linked to rotate in the second rotation direction C2. At the same time, the stopping shaft S is relatively moved to a distal end of the inclined surface 324 of the through opening 321 (FIG. 6B) from the proximal end of the inclined surface 324 (FIG. 6C), and then the stopping shaft S exactly abuts against the stopping surface 322. Meanwhile, the transmission portion 400 deforms the second spring 600 such that the second spring 600 generates the second restoring elastic force for driving the transmission portion 400 to rotate in the first rotation direction C1.

In the meantime, referring to FIG. 5B to FIG. 6C, since the transmission portion 400 rotates in the second rotation direction C2, the displacement piece 720 is linked to linearly move towards the electromagnet 730.

Due to the magnetic force of the electromagnet 730, the displacement piece 720 is magnetically attracted by the electromagnet 730. Because the strength of magnetic force of the electromagnet 730 is greater than the strength of the second restoring elastic force of the second spring 600, the transmission portion 400 still stays in a stationary state.

Figure 6D:
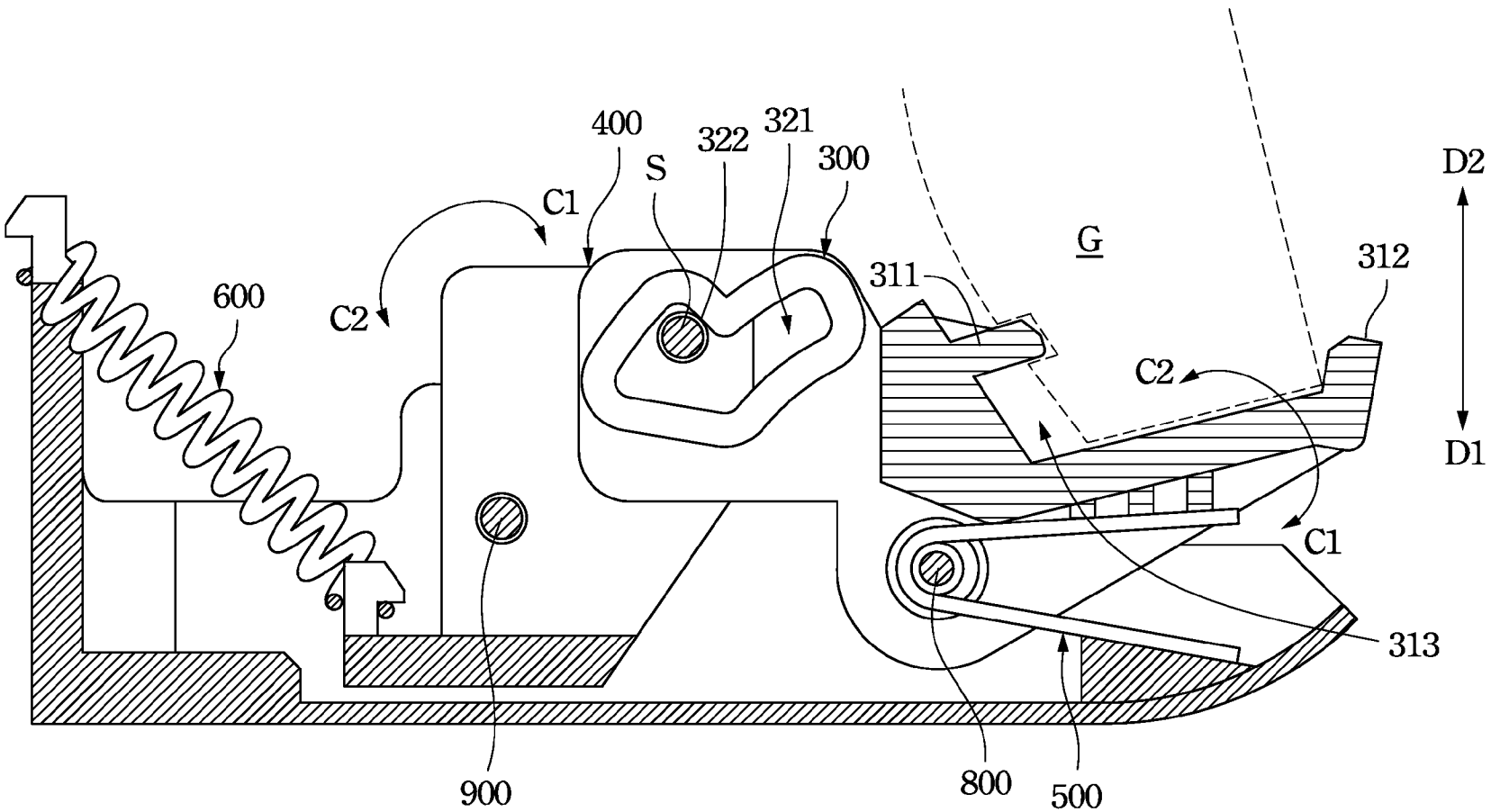

Referring to FIG. 6D, when the pressing strength exerted by the user on the object G towards the object-gripping trench 313 disappears, because the first restoring elastic force of the first spring 500 starts to drive the fastening portion 300 to rotate in the second rotation direction C2, the fastening portion 300 is driven to rotate in the second rotation direction C2 until the stopping surface 322 is contacted and stopped by the stopping shaft S, i.e. the stopping shaft S and the stopping surface 322 are pressed against with each other. In this moment, since the fastening portion 300 cannot further rotate in the second rotation direction C2, the object G can be fixedly gripped in the object-gripping trench 313.

Figure 7:
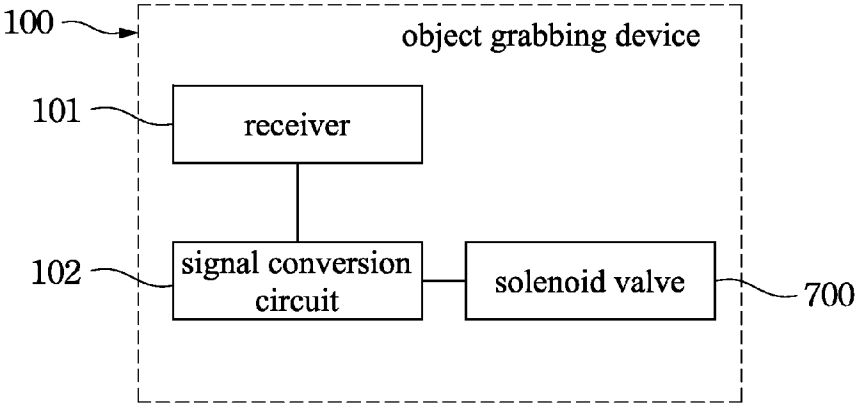
FIG. 7 is a circuit block diagram of an object gripping device using a electromagnetic assembly according to another embodiment of the present disclosure.

Reference is now made to FIG. 7. FIG. 7 is a circuit block diagram of an object gripping device 100 using a electromagnetic assembly 700 according to another embodiment of the present disclosure.

Referring to FIG. 7, the object gripping device 100 further comprises a receiver 101 and a signal conversion circuit 102. The receiver 101 is used for receiving an external sensing signal, and the sensing signal is not limited in types, for example, RFID, Infrared or Bluetooth signals. The signal conversion circuit 102 is electrically connected to the receiver 101 and the electromagnetic assembly 700, and is used for converting the sensing signal into a trigger signal.

Therefore, referring to FIG. 6A, when a trigger signal is passed to the electromagnetic assembly 700 to enable the strength of magnetic force of the electromagnet 730 to be smaller than the strength of the second restoring elastic force of the second spring 600, because of the second restoring elastic force of the second spring 600, the second spring 600 starts to pull and rotate the transmission portion 400 in the first rotation direction C1. Synchronously, the transmission portion 400 moves the displacement piece 720 away from the electromagnet 730, such that the stopping shaft S is relatively moved into the receiving area 323 with respect to the displacement piece 720 when the stopping shaft S is detached from the stopping surface 322. The stopping shaft S fails to restrict the fastening portion 300 from rotating in the second rotation direction C2, and thus, the object G is no longer to be fixedly gripped, and can be released from the object-gripping trench 313.

Figure 8:
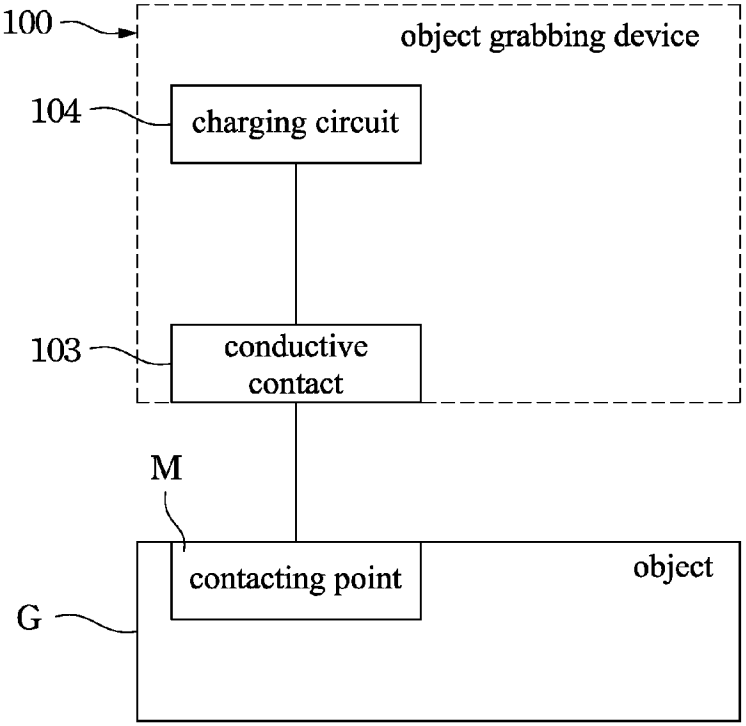
FIG. 8 is a circuit block diagram of the object gripping device using the electromagnetic assembly according to the other embodiment of the present disclosure.

FIG. 8 is a circuit block diagram of an object gripping device using a electromagnetic assembly according to the other embodiment of the present disclosure.

In the other embodiment of the present disclosure, the object gripping device 100 further provides a power charging function, and further comprises at least one conductive contact 103 and a charging circuit 104. The conductive contact 103 is disposed in the object-gripping trench 313. Thus, when the object G is placed in the object-gripping trench 313, the conductive contact 103 physically contacts a contacting point M of the object G. The charging circuit 104 is electrically connected to the conductive contact 103 and the contacting point M of the object G for charging the object G via the conductive contact 103.

To sum up, since the object gripping device using the electromagnetic assembly not only provides an exhibiting placement, but also provides a concealed security locking means for the exhibited object, the appearance of the exhibition site is simplified, the atmosphere in the exhibition site is better, and purchasing intentions of customers is improved.

Although the present disclosure has been described with reference to the preferred embodiments thereof, it is apparent to those skilled in the art that a variety of modifications and changes may be made without departing from the scope of the present disclosure which is intended to be defined by the appended claims.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. An object gripping device, comprising:

a base;

a fastening portion pivoted at one end of the base, wherein an object-gripping trench is formed at one end of the fastening portion, and a through opening with a stopping surface is formed at another end of the fastening portion;

a first spring connected the base and the fastening portion for driving the fastening portion to rotate in a first rotation direction;

a transmission portion pivoted at another end of the base;

a stopping shaft passing through the transmission portion and the through opening;

a second spring connected to the base and the transmission portion for driving the transmission portion to rotate in a second rotation direction opposite to the first rotation direction; and an electromagnetic assembly, comprising:

an outer case fixed on the other end of the base;

a displacement piece linearly and movably disposed on the outer case, and connected to the transmission portion; and an electromagnet disposed in the outer case, wherein the displacement piece is magnetically attracted to the electromagnet by a magnetic force thereof so as to stop the transmission portion from rotating in the second rotation direction under the influence of the second spring, the stopping of the rotation of the transmission portion in the second rotation direction causes the stopping shaft to contacts the stopping surface of the through opening, thereby stopping the fastening portion from rotating in the first rotation direction under the influence of the first spring and allowing an object to be fixedly gripped in the object-gripping trench; and wherein according to a trigger signal, the electromagnet reduces the magnetic force attracting the displacement piece thereto, causing the transmission portion to be allowed to rotate in the second rotation direction under the influence of the second spring, thereby causing the stopping shaft to be detached from the stopping surface of the through opening, and allowing the fastening portion to rotate in the first direction under the influence of the first spring to release the object from the object-gripping trench.

2. The object gripping device according to claim 1, wherein the fastening portion further comprises:

a protruding portion disposed on a top edge of the object-gripping trench, for being inserted into a recess of the object, thereby fixedly gripping the object in the object-gripping trench.

3. The object gripping device according to claim 1, wherein the stopping surface is located on one of a plurality of inner surfaces of the through opening.

4. The object gripping device according to claim 3, wherein the through opening further comprises:

a receiving area defined in the through opening and located closer to the object-gripping trench than the stopping surface, wherein the stopping shaft is located in the receiving area when the stopping shaft is detached from the stopping surface so as to allow the fastening portion to rotate.

5. The object gripping device according to claim 4, wherein the through opening further comprises:

an inclined surface located at another one of the plurality of inner surfaces of the through opening, wherein the inclined surface is located opposite to the stopping surface and away from the receiving area, wherein the fastening portion rotates in the second rotation direction to deform the first spring as the object is introduced into the object-gripping trench, causing the inclined surface to lift the stopping shaft so as to rotate the transmission portion in the first rotation direction, thereby allowing the displacement piece to be magnetically attracted to the electromagnet.

6. The object gripping device according to claim 1, wherein a connection plate is disposed on the other end the fastening portion, wherein the through opening is formed in the connection plate; and two lugs are disposed on an end of the transmission portion through which the stopping shaft passes, and a gap is defined between the two lugs;

wherein the connection plate is disposed between the two lugs such that the through opening is located in the gap.

7. The object gripping device according to claim 1, further comprising:

a receiver for receiving an external sensing signal;

a signal conversion circuit electrically connected to the receiver and the electromagnet for converting the sensing signal into the trigger signal.

8. The object gripping device according to claim 1, further comprising:

at least one conductive contact disposed in the object-gripping trench; and a charging circuit electrically connected to the at least one conductive contact for charging the object fixedly gripped in the object-gripping trench via the conductive contact.

9. The object gripping device according to claim 1, wherein the first spring is a torsion spring or an extension spring.

10. The object gripping device according to claim 1, wherein the second spring is a torsion spring or an extension spring.

* * * * *